United States Patent [19]

Hardt

[11] 4,328,905

[45] May 11, 1982

[54] METAL CAN WITH MEMBRANE TYPE CLOSURE

[75] Inventor: Jean Hardt, Benken, Switzerland

[73] Assignee: Swiss Aluminium Ltd., Chippis, Switzerland

[21] Appl. No.: 237,856

[22] Filed: Feb. 25, 1981

[30] Foreign Application Priority Data

Mar. 25, 1980 [CH] Switzerland ..... 2305/80

[51] Int. Cl.[3] ..... B65D 51/22

[52] U.S. Cl. ..... 220/258; 220/359

[58] Field of Search ..... 220/258, 359

[56] References Cited

U.S. PATENT DOCUMENTS 2,044,677 6/1936 Freeman ..... 220/258

3,537,610 11/1970 Bilon ..... 220/258

4,133,447 1/1979 Bouchet ..... 220/258

*Primary Examiner*—George T. Hall

*Attorney, Agent, or Firm*—Bachman and LaPointe

[57] ABSTRACT

A metal can with a membrane covering the opening in the can is sealed to a circumferential flange which is part of a necked-down region on the can body. The necked-down region can be provided directly at the edge of the opening end of the can body and the flange can be in the form of an end flange. It may, however, also be provided at such a distance from the edge of the can body at the opening end of the can, that a cylindrical extension results beyond the flange.

By forming the flange directly on the can body, the can, which is able to be used widely, can be made simply and in a manner which saves material.

11 Claims, 3 Drawing Figures

METAL CAN WITH MEMBRANE TYPE CLOSURE

BACKGROUND OF THE INVENTION

The present invention relates to a can made of metal, and provided with a membrane which is sealed onto a circumferential flange to close off the opening in the can.

Cans of this kind are known, but the membrane closure is in fact sealed onto a circumferential flange on a lid-ring flanged onto the body of the can. Such cans are, however, relatively expensive as it is necessary to manufacture an additional part, that is the ring for the lid. Furthermore, such cans are suitable only for contents which can be poured.

Also known is a can with a membrane type closure sealed onto an outward pointing circumferential flange which is shaped onto the edge of the can at the end to be opened. A disadvantage of this can is, however, that it does not lend itself well to stacking.

It is therefore the principal object of the present invention to develop a can of the kind mentioned above which can be manufactured simply, saves material, and can be widely used.

SUMMARY OF THE INVENTION

The foregoing object is achieved by way of the present invention wherein the flange is part of a necked-down region on the can body.

The necking can be made directly at the end of the can body which is to be opened, so that the resultant flange is one which bends outwards. Such a can is particularly suitable for contents which can be poured such as fluids and powders. In order to protect the membrane from mechanical damage, the can may be provided with a push-down lid which, for safety, features a projection which engages in a groove running around the can body.

The necked-down region featuring the end flange can, however, also be displaced radially outwards in such a way that the diameter of the opening formed by the necked-down region is essentially the same size as the inner diameter of the can body. This design of the end to be opened makes it possible for such a can also to be used for contents which cannot be poured such as meat pastes. When a push-down lid is used, this usefully features at the edge a bulge or projection which engages by virtue of its shape onto the outward projecting edge of the can.

Another preferred design of the opening end of the can is such that the necked-down region is provided at such a distance from the edge of the can body at its opening end that a cylindrically shaped extension is formed beyond the flange, the diameter of the extension being essentially the same size as that of the can body. Such a can is particularly suitable for contents which are pre-packed in pouches. This can is fitted with a push-fit lid which engages with the extension by friction or mechanically, by virtue of its shape.

All common metallic can materials, in particular tin plate and aluminum, can be used for the can body. The can is manufactured first by making, in a conventional manner, a cylindrical can body with welded or soldered longitudinal seam. Next the necking down is carried out in a generally known device. In order that the flattest possible flange may be achieved, the can body is laid over the tool during the rolling process used to form the necked-down region. At the same time as the necked-down region is made at the opening end of the can body, the bottom edge of the body can be shaped for flanging with the bottom part of the can. The body may, however, also be made out of aluminum with the bottom as an integral part by drawing and ironing or by impact extrusion.

The material used for the membrane depends on the requirements. It can for example be made of metal foil, in particular aluminum foil, plastic foil, paper or a laminate comprising a combination of these materials. The membrane may be provided with a tear-back tab. The membrane is joined to the flange in a known manner using sealing facilities.

The sealable plastic can be provided as a coating on the membrane and/or the flange.

The push-down or push-fit lid may be made of plastic, metal or cardboard.

After forming the necked-down region, this part is usually pressed flat in a further rolling or upsetting operation so that the flange lies in the underlying part of the necked region. It can, however, be advantageous not to press the necked part flat, as any irregularities can then be compensated for when sealing-on the membrane, in particular when employing an end flange. A further advantage of this design is that, when can bodies with lacquer on the inside are made out of sheet which is lacquered on one side, and the necking is carried out without subsequently pressing that part flat, the layer of lacquer remains intact and there is no need to lacquer the part afterwards.

BRIEF DESCRIPTION OF THE DRAWINGS

Further advantages, features and details of the present invention are revealed in the following description of exemplified embodiments and with the help of the drawings wherein.

DETAILED DESCRIPTION

Figure 1:
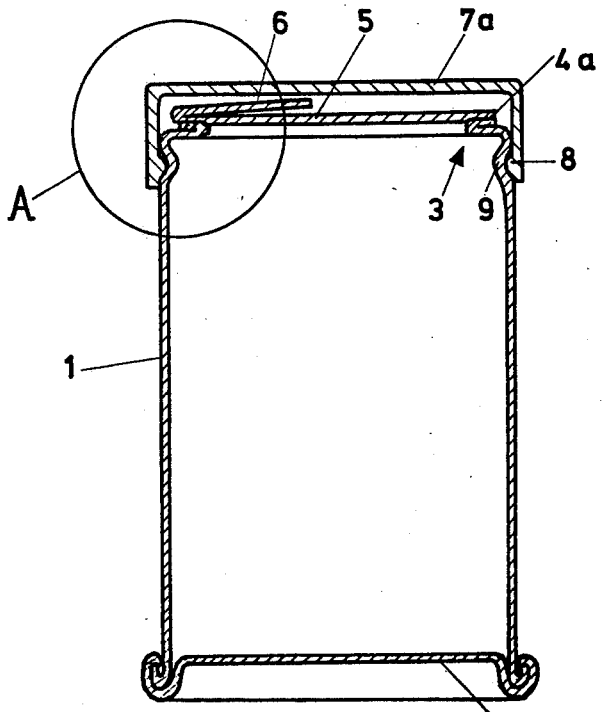
FIG. 1: A cross section through a can with membrane cover and push-down lid.

The can in FIG. 1 features a cylindrical body 1 with flanged-on bottom 2. The upper edge of the can body is provided with a necked-down region 3 part of which has been bent into an outward pointing end flange 4*a* and rests on the lower part of the necked-down region 3. Sealed onto the end flange 4*a* is a membrane 5 with a tear-back tab 6. The can is provided with a push-down lid 7*a* which features at its edge a bulge or projection 8 which engages in a groove 9 on the can body 1.

Figure 2:
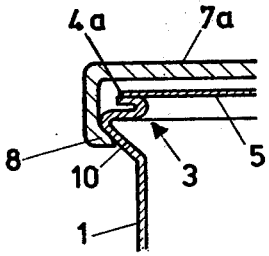
FIG. 2: Another version of region A in FIG. 1.

In the version shown in FIG. 2 the necked-down region 3 at the upper edge of the can body 1 is displaced radially outwards together with the end flange 4*a* in such a way that the diameter of the opening formed by the necked-down part 3 is the same as the inside diameter of the can body 1. Here, the end flange 4*a* does not lie in the lower part of the necked region. The bulge 8 on the push-down lid 7*a* engages on the projecting piece 10.

Figure 3:
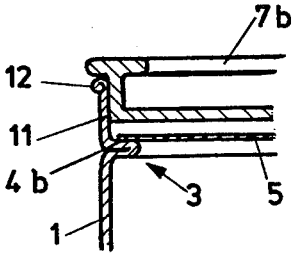
FIG. 3: A further version of region A in FIG. 1.

FIG. 3 shows another version in which the necked-down region 3 is provided at such a distance from the edge of the can body 1 that there is a cylindrical extension 11 beyond the flange 4*b*, the diameter of the extension 11 being the same as that of the can body 1.

The edge 12 of the extension 11 has been rolled over outwards and a push-fit lid 7 engages with the inner face of the extension 11.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A can having a bottom, a substantially cylindrical side wall and an opening sealed by a membrane, said opening being bounded by a flange formed by said side wall at an angle substantially perpendicular to the plane of said side wall, said flange including a first straight portion extending from said side wall in a first direction substantially perpendicular to the plane of said side wall, an upwardly directed curl portion extending from said first straight portion and a second straight portion extending from said upwardly directed curl portion in a second direction opposite said first direction such that said first straight portion and said second straight portion are substantially parallel with respect to each other whereby said membrane seals on said second straight portion.

2. A can according to claim 1 wherein said side wall is provided with means for securing a lid to said can.

3. A can according to claim 2 wherein said means for securing said lid comprises a groove extending around the periphery of said side wall.

4. A can according to claim 2 wherein said means for securing said lid comprises an upwardly directed bent out side wall portion.

5. A can according to claim 4 wherein said first straight portion extends from said bent out side wall portion.

6. A can according to claim 2 wherein said means for securing said lid comprises a third straight portion extending upwardly from said second straight portion in a direction substantially perpendicular to said second straight portion.

7. A can according to claim 6 wherein said side wall and said third straight portion lie substantially in the same plane.

8. A can according to claim 5 wherein the size of the opening is substantially equal to the inner dimensions of said can.

9. A can according to claim 3 wherein said lid is provided with a nib for engaging said groove.

10. A can according to claim 5 wherein said lid is provided with a nib for engaging said bent out portion.

11. A can according to claim 6 wherein said lid is press fit in said third straight portion.

* * * * *